US006682317B2

(12) United States Patent
Chen

(10) Patent No.: US 6,682,317 B2
(45) Date of Patent: Jan. 27, 2004

(54) MINIATURE AIR COMPRESSOR

(75) Inventor: Kwang-Tsan Chen, Taipei (TW)

(73) Assignee: Ding Hua Co., Ltd., Taiwan (TW)

( * ) Notice: Subject to any disclaimer, the term of this patent is extended or adjusted under 35 U.S.C. 154(b) by 33 days.

(21) Appl. No.: 10/176,702

(22) Filed: Jun. 20, 2002

(65) Prior Publication Data

US 2003/0235507 A1 Dec. 25, 2003

(51) Int. Cl.[7] ..... F04B 39/00; F04B 23/00

(52) U.S. Cl. ..... 417/312; 417/313; 417/415; 417/571

(58) Field of Search ..... 417/312, 415, 417/313, 571

(56) References Cited

U.S. PATENT DOCUMENTS 3,877,842 A * 4/1975 Greene et al. ..... 417/312
4,028,015 A * 6/1977 Hetzel ..... 417/415
4,995,795 A * 2/1991 Hetzel et al. ..... 417/571
5,549,454 A * 8/1996 Earle ..... 417/312
6,508,637 B2 * 1/2003 Ohashi ..... 417/454

* cited by examiner

*Primary Examiner*—Justine R. Yu
*Assistant Examiner*—Michael K. Gray
(74) *Attorney, Agent, or Firm*—Connolly Bove Lodge & Hutz

(57) ABSTRACT

A miniature air compressor includes a motor, a compression cylinder, a lower valve seat, an upper valve seat, and a noise suppression cylinder. Thus, the miniature air compressor may provide a stable pressurized air flow whose noise and impurity may be eliminated by the noise suppression cylinder, thereby enhancing the usage effect of the injection pen device. In addition, the miniature air compressor has a simple construction, may be assembled and amended easily and conveniently, and may reduce the cost of production.

8 Claims, 5 Drawing Sheets

MINIATURE AIR COMPRESSOR

BACKGROUND OF THE INVENTION

1. Field of the Invention

The present invention relates to a miniature air compressor, and more particularly to a miniature air compressor that may provide a stable pressurized air flow whose noise and impurity may be eliminated by the noise suppression cylinder, thereby enhancing the usage effect of the injection pen device.

2. Description of the Related Art

A conventional air compressor may be used in an injection pen driven by a pneumatic tool, so that the injection pen may evenly inject various paint for coloring patterns.

The closest prior art of which the applicant is aware is disclosed in the Taiwanese Patent Publication No. 369089, entitled by "Air Compressor". The air compressor includes a valve plug secured in a valve chamber, a spring having a first end mounted on the valve plug and a second end provided with an air valve which may be rested on the valve port for controlling the direction of the air flow. However, the air compressor has a complicated construction. In addition, the spring is pushed and moved reciprocally, so that the spring easily produces fatigue, and so that the air valve cannot seal and close the valve port completely.

SUMMARY OF THE INVENTION

The present invention has arisen to mitigate and/or obviate the disadvantage of the conventional air compressor.

The primary objective of the present invention is to provide a miniature air compressor that may provide a stable pressurized air flow whose noise and impurity may be eliminated by the noise suppression cylinder, thereby enhancing the usage effect of the injection pen device.

Another objective of the present invention is to provide a miniature air compressor that has a simple construction.

A further objective of the present invention is to provide a miniature air compressor that may be assembled and amended easily and conveniently, and may reduce the cost of production.

In accordance with the present invention, there is provided a miniature air compressor, comprising a motor, a compression cylinder, a lower valve seat, an upper valve seat, and a noise suppression cylinder, wherein:

the motor has a central shaft for driving an eccentric cam which may drive a piston crank to move upward and downward reciprocally, so that a piston mounted in the compression cylinder may be axially moved upward and downward reciprocally;

the compression cylinder is secured on the motor;

the lower valve seat is mounted on the compression cylinder, and has a first side formed with an air inlet recess and a second side formed with an air outlet recess, the air inlet recess of the lower valve seat has a top face formed with an arcuate cavity, an air inlet valve plate is movably mounted in the arcuate cavity of the air inlet recess of the lower valve seat, the air outlet recess of the lower valve seat has a top face formed with an annular protruding push post for pushing an air outlet valve plate upward;

the upper valve seat is mounted on a top face of the lower valve seat, and has a first side formed with an air inlet and a second side formed with an air outlet, the air inlet of the upper valve seat has a bottom formed with a protruding push post for pushing the air inlet valve plate downward, the air outlet of the upper valve seat has a bottom formed with an arcuate cavity, and the air outlet valve plate is movably mounted in the arcuate cavity of the air outlet of the upper valve seat; and the noise suppression cylinder is secured on the motor, an air inlet pipe has a fist end mounted on a top end of the noise suppression cylinder, and a second end mounted on a top face of the air inlet of the upper valve seat.

Further benefits and advantages of the present invention will become apparent after a careful reading of the detailed description with appropriate reference to the accompanying drawings.

DETAILED DESCRIPTION OF THE INVENTION

Figure 1:
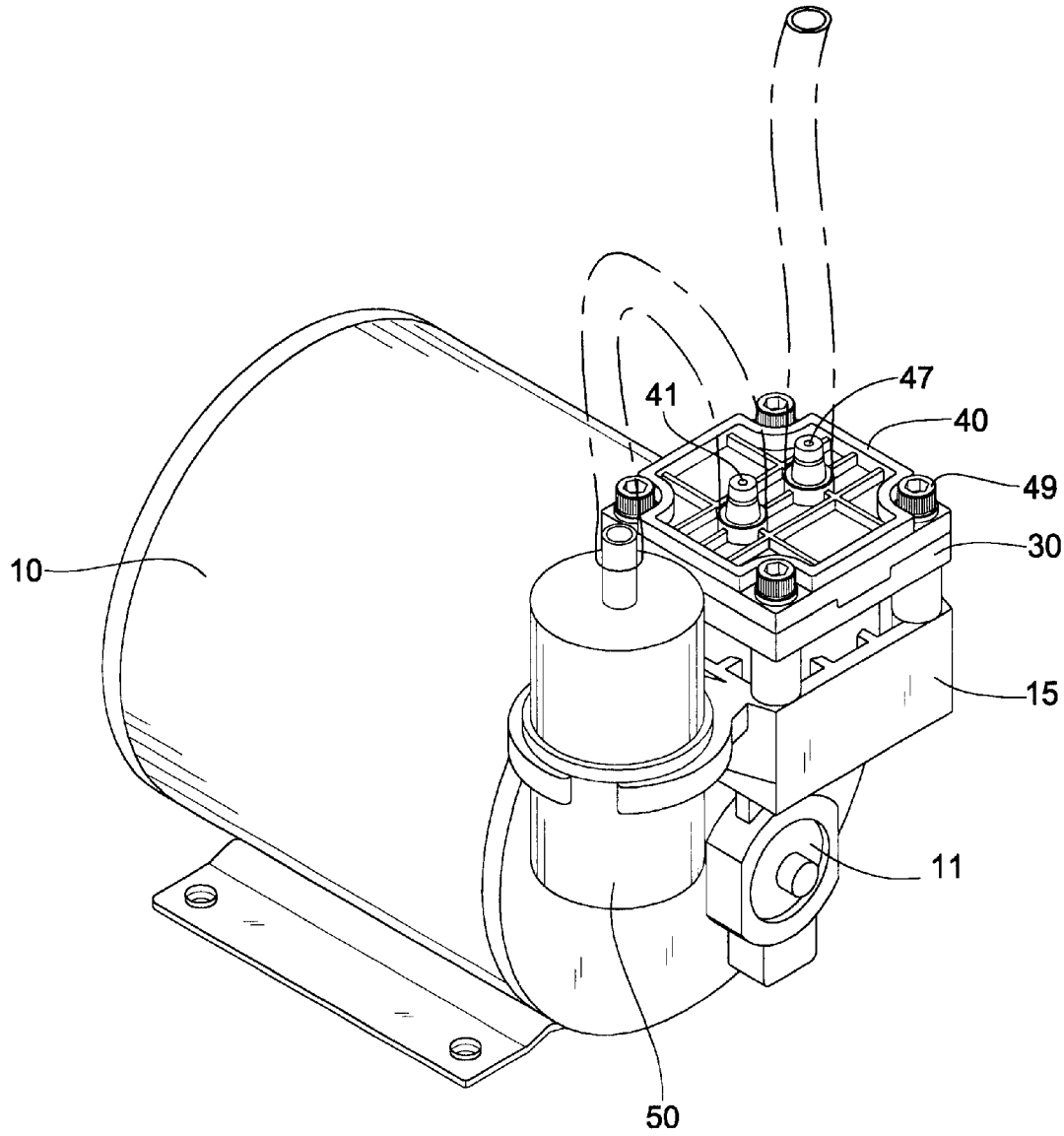
FIG. 1 is a perspective view of a miniature air compressor in accordance with a preferred embodiment of the present invention.
Figure 2:
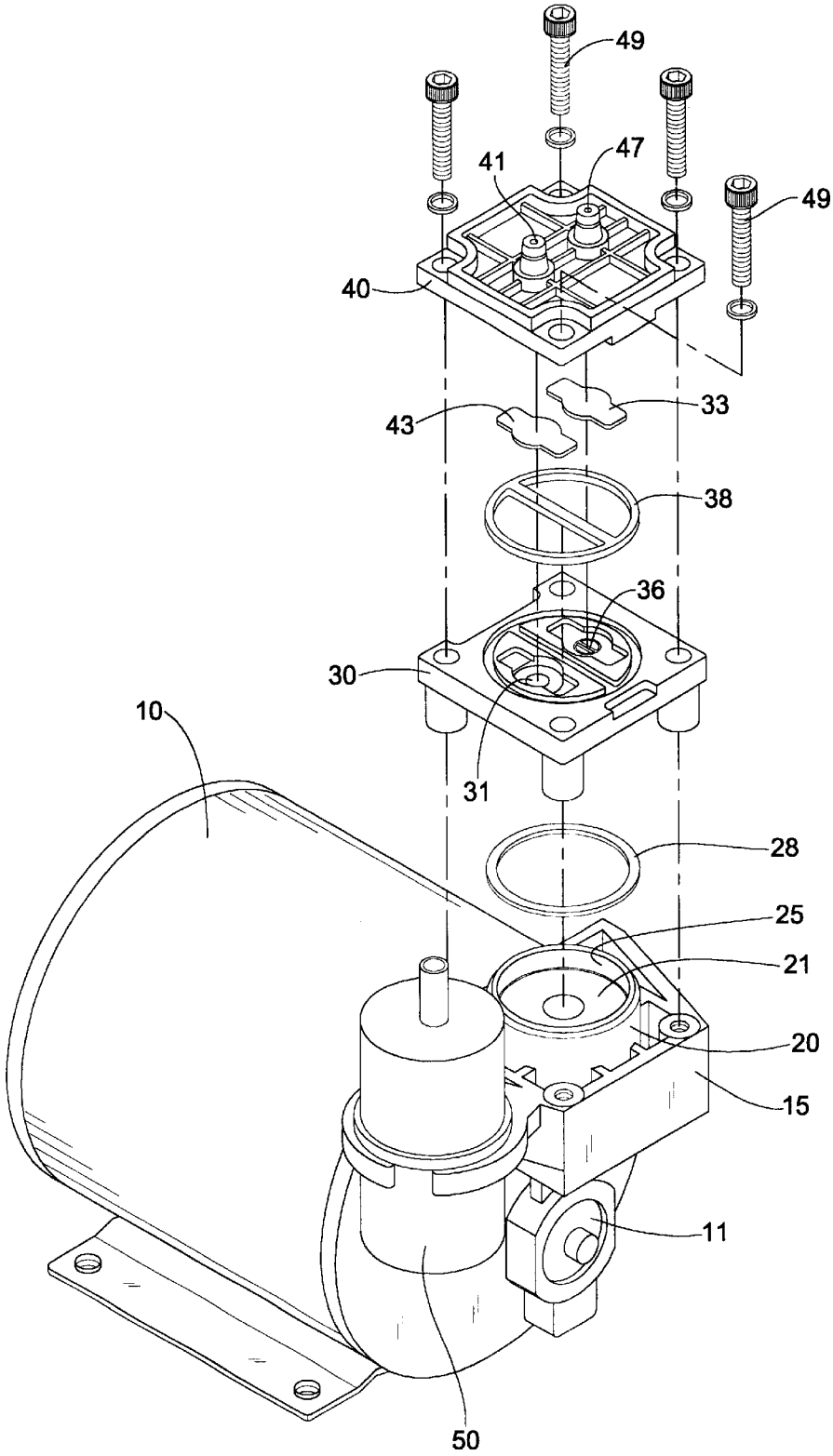
FIG. 2 is an exploded perspective view of the miniature air compressor as shown in FIG. 1.
Figure 3:
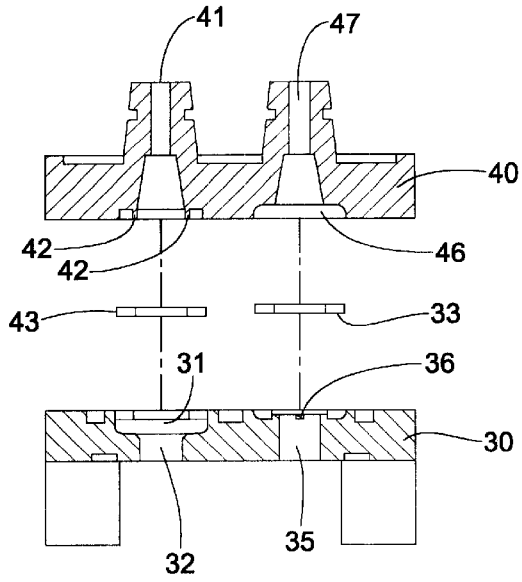
FIG. 3 is a plan cross-sectional view of the lower valve seat and the upper valve seat of the miniature air compressor as shown in FIG. 2.

Referring to the drawings and initially to FIGS. 1–4, a miniature air compressor in accordance with a preferred embodiment of the present invention comprises a motor 10, a compression cylinder 20, a lower valve seat 30, an upper valve seat 40, and a noise suppression cylinder 50.

The motor 10 has a central shaft for driving an eccentric cam 11 which may drive a piston crank 12 to move upward and downward reciprocally, so that a piston 21 mounted in the compression cylinder 20 may be axially moved upward and downward reciprocally. The motor 10 is provided with a fixing seat 15.

The compression cylinder 20 is a boosting cylinder for pushing the air to flow. The compression cylinder 20 is secured in the fixing seat 15 of the motor 10, and is formed with a hollow air chamber 25. The piston 21 is axially and slidably mounted in the hollow air chamber 25 of the compression cylinder 20. The piston crank 12 is mounted on a bottom end of the piston 21.

The lower valve seat 30 is used to control the flow direction of the air. The lower valve seat 30 is closely and sealingly mounted on a top edge of the compression cylinder 20, and a washer 28 is mounted between the lower valve seat 30 and the top edge of the compression cylinder 20. The lower valve seat 30 has a first side formed with an air inlet recess 32 and a second side formed with an air outlet recess 35. The air inlet recess 32 of the lower valve seat 30 has a top face formed with an arcuate cavity 31. An air inlet valve plate 43 is movably mounted in the arcuate cavity 31 of the air inlet recess 32 of the lower valve seat 30. The air outlet recess 35 of the lower valve seat 30 has a top face formed with an annular protruding push post 36 for pushing an air outlet valve plate 33 upward, thereby preventing the air from flowing back reversely.

The upper valve seat 40 is an air flow control seat that is mounted on a top face of the lower valve seat 30, and a washer 38 is mounted between the upper valve seat 40 and the top face of the lower valve seat 30. The upper valve seat 40 has a first side formed with an air inlet 41 and a second side formed with an air outlet 47. The air inlet 41 of the upper valve seat 40 has a bottom formed with a protruding push post 42 for pushing the air inlet valve plate 43 downward, thereby preventing the air from flowing back reversely. The air outlet 47 of the upper valve seat 40 has a bottom formed with an arcuate cavity 46, and the air outlet valve plate 33 is movably mounted in the arcuate cavity 46 of the air outlet 47 of the upper valve seat 40. An air outlet pipe 48 is mounted on the top end of the air outlet 47 of the upper valve seat 40 for supplying a stable pressurized air flow of the injection pen. The upper valve seat 40 and the lower valve seat 30 are screwed on the fixing seat 15 of the motor 10 by multiple bolts 49.

The noise suppression cylinder 50 is secured on the fixing seat 15 of the motor 10, and has an inside provided with a noise suppression cotton 51 and an air pipe 53. An air inlet pipe 55 has a fist end mounted on the top end of the noise suppression cylinder 50, and a second end mounted on the top face of the air inlet 41 of the upper valve seat 40.

Thus, in the miniature air compressor in accordance with the preferred embodiment of the present invention, the noise suppression cylinder 50 may eliminate the noise and impurity of the air in the air pipe 53 by the noise suppression cotton 51.

Figure 4:
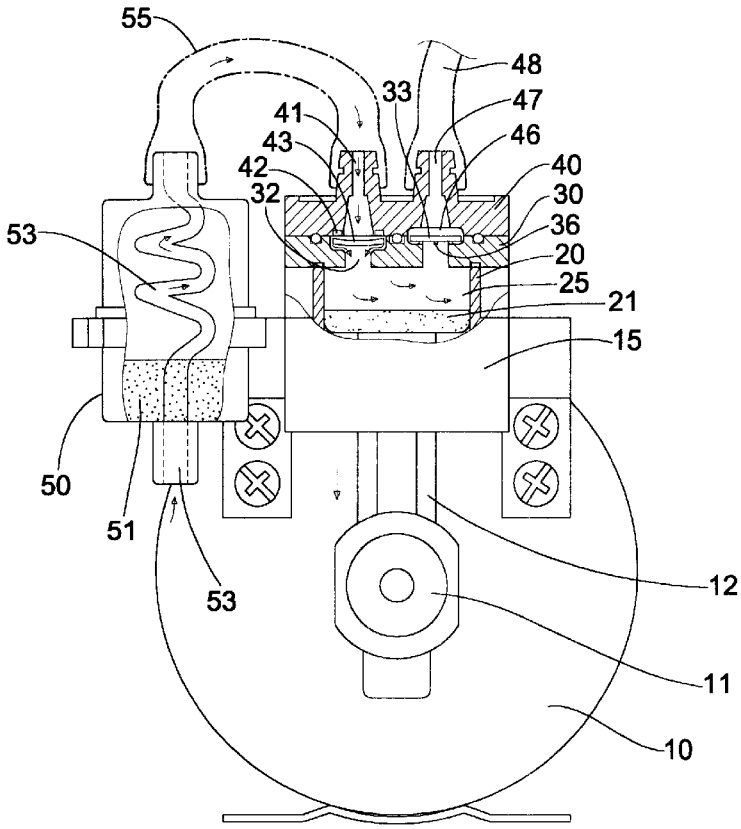
FIG. 4 is a side plan cross-sectional view of the miniature air compressor as shown in FIG. 1.

In operation, as shown in FIG. 4, when the compression cylinder 20 is disposed at an air inlet state, the piston crank 12 and the piston 21 are moved downward, so that the hollow air chamber 25 of the compression cylinder 20 is disposed at a negative pressure state.

Thus, the air inlet valve plate 43 is detached from the push post 42 of the air inlet 41 of the upper valve seat 40, and is forced to move downward to be received in the arcuate cavity 31 of the air inlet recess 32 of the lower valve seat 30, so that the air may be supplied into the hollow air chamber 25 of the compression cylinder 20. In addition, the air outlet valve plate 33 is forced to move downward to closely seal the annular protruding push post 36 of the air outlet recess 35 of the lower valve seat 30, thereby preventing the air from flowing back into the air outlet 47 of the upper valve seat 40 during the air inlet process.

Figure 5:
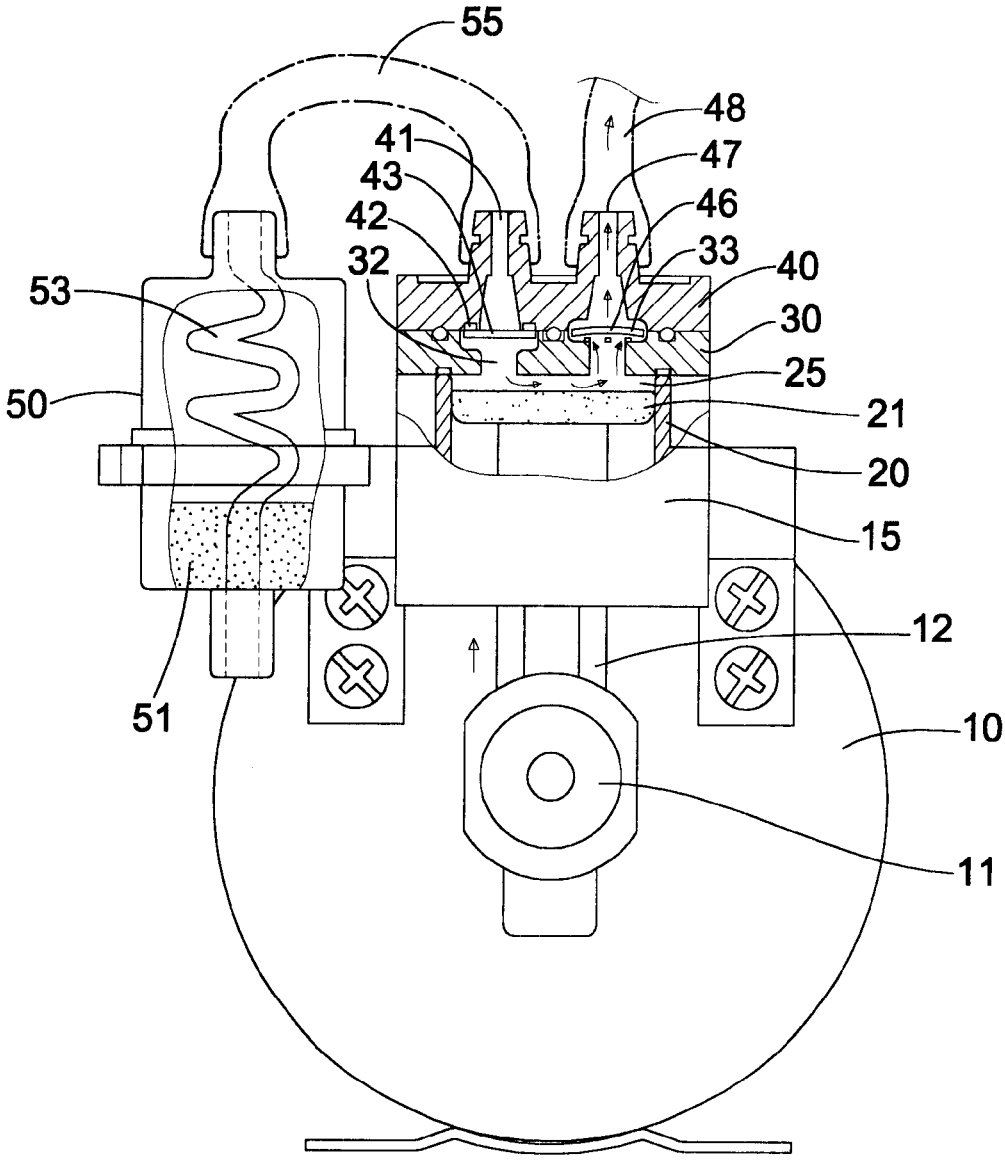
FIG. 5 is a schematic operational view of the miniature air compressor as shown in FIG. 4 in use.

As shown in FIG. 5, when the compression cylinder 20 is disposed at an air outlet state, the piston crank 12 and the piston 21 are moved upward, so that the compressed air contained in the hollow air chamber 25 of the compression cylinder 20 may push the air inlet valve plate 43 and the air outlet valve plate 33 upward, so that the air inlet valve plate 43 may be moved upward to closely seal the push post 42 of the air inlet 41 of the upper valve seat 40, thereby preventing the air from flowing back into the air inlet 41 of the upper valve seat 40 during the air outlet process. In addition, the air outlet valve plate 33 is detached from the annular protruding push post 36 of the air outlet recess 35 of the lower valve seat 30, and is forced to move upward to be received in the arcuate cavity 46 of the air outlet 47 of the upper valve seat 40, so that the pressurized compressed air may be conveyed outward through the air outlet pipe 48 along a single direction only, and may be carried and guided into the injection pen device.

Figure 6:
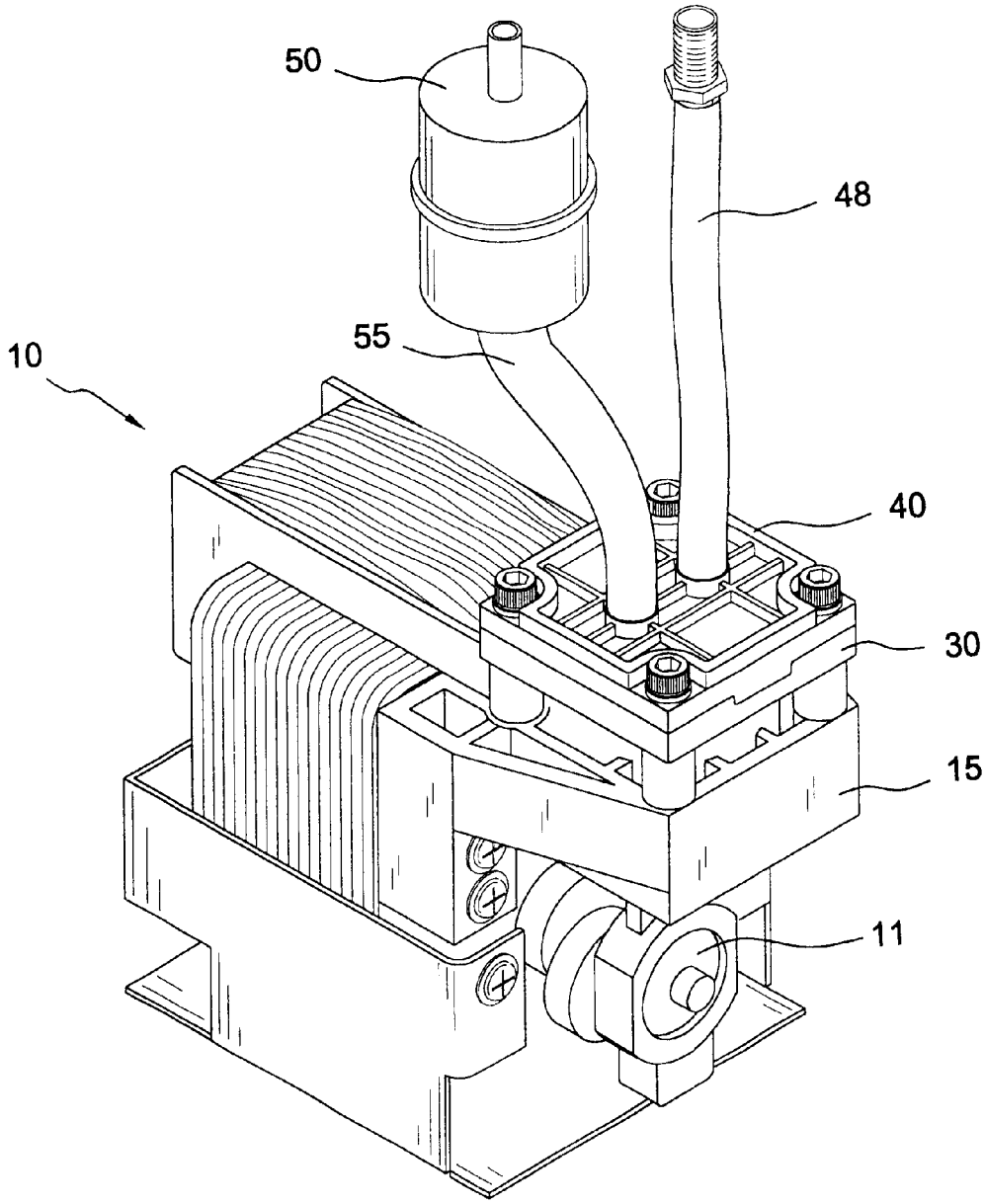
FIG. 6 is a perspective view of a miniature air compressor in accordance with another preferred embodiment of the present invention.

As shown in FIG. 6, a miniature air compressor in accordance with another preferred embodiment of the present invention is shown.

Accordingly, the miniature air compressor in accordance with the preferred embodiment of the present invention may provide a stable pressurized air flow, wherein the noise and impurity of the air in the air pipe 53 may be eliminated by the noise suppression cotton 51, thereby enhancing the usage effect of the injection pen device.

In addition, the miniature air compressor in accordance with the preferred embodiment of the present invention has a simple construction, may be assembled and amended easily and conveniently, and may reduce the cost of production.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A miniature air compressor, comprising a motor, a compression cylinder, a lower valve seat, an upper valve seat, and a noise suppression cylinder, wherein:

the motor has a central shaft that drives an eccentric cam that drives a piston crank to move upward and downward reciprocally, so that a piston mounted in the compression cylinder may be axially moved upward and downward reciprocally;

the compression cylinder is secured on the motor;

the lower valve seat is mounted on the compression cylinder, and has a first side formed with an air inlet recess and a second side formed with an air outlet recess, the air inlet recess of the lower valve seat has a top face formed with an arcuate cavity, an air inlet valve plate is movably mounted in the arcuate cavity of the air inlet recess of the lower valve seat, the air outlet recess of the lower valve seat has a top face formed with an annular protruding push post for pushing an air outlet valve plate upward;

the upper valve seat is mounted on a top face of the lower valve seat, and has a first side formed with an air inlet and a second side formed with an air outlet, the air inlet of the upper valve seat has a bottom formed with a protruding push post for pushing the air inlet valve plate downward, the air outlet of the upper valve seat has a bottom formed with an arcuate cavity, and the air outlet valve plate is movably mounted in the arcuate cavity of the air outlet of the upper valve seat; and the noise suppression cylinder is secured on the motor, an air inlet pipe has a fist end mounted on a top end of the noise suppression cylinder, and a second end mounted on a top face of the air inlet of the upper valve seat.

2. The miniature air compressor in accordance with claim 1, wherein the motor is provided with a fixing seat, and the compression cylinder is secured in the fixing seat of the motor.

3. The miniature air compressor in accordance with claim 1, wherein the compression cylinder is formed with a hollow air chamber, the piston is axially and slidably mounted in the hollow air chamber of the compression cylinder, and the piston crank is mounted on a bottom end of the piston.

4. The miniature air compressor in accordance with claim 1, further comprising a washer mounted between the lower valve seat and a top edge of the compression cylinder.

5. The miniature air compressor in accordance with claim 1, further comprising a washer mounted between the upper valve seat and the top face of the lower valve seat.

6. The miniature air compressor in accordance with claim 1, further comprising an air outlet pipe mounted on the top end of the air outlet of the upper valve seat.

7. The miniature air compressor in accordance with claim 2, wherein the upper valve seat and the lower valve seat are screwed on the fixing seat of the motor by multiple bolts.

8. The miniature air compressor in accordance with claim 1, wherein the noise suppression cylinder has an inside provided with a noise suppression cotton and an air pipe.

* * * * *